US010836975B2

(12) United States Patent
Takahashi et al.

(10) Patent No.: US 10,836,975 B2
(45) Date of Patent: Nov. 17, 2020

(54) REFRIGERATOR OIL

(71) Applicant: ENEOS Corporation, Tokyo (JP)

(72) Inventors: Hitoshi Takahashi, Tokyo (JP); Kentaro Yamaguchi, Tokyo (JP); Souichirou Konno, Tokyo (JP); Fumiyuki Nara, Tokyo (JP)

(73) Assignee: ENEOS Corporation, Tokyo (JP)

( * ) Notice: Subject to any disclaimer, the term of this patent is extended or adjusted under 35 U.S.C. 154(b) by 0 days.

(21) Appl. No.: 15/522,633

(22) PCT Filed: Oct. 23, 2015

(86) PCT No.: PCT/JP2015/079983
§ 371 (c)(1),
(2) Date: Apr. 27, 2017

(87) PCT Pub. No.: WO2016/072296
PCT Pub. Date: May 12, 2016

(65) Prior Publication Data

US 2017/0327763 A1 Nov. 16, 2017

(30) Foreign Application Priority Data

Nov. 4, 2014 (JP) ..... 2014-224307

(51) Int. Cl.

| | |
|---|---|
| ***C10M 173/02*** | (2006.01) |
| ***C10M 141/10*** | (2006.01) |
| ***C10M 137/10*** | (2006.01) |
| ***C10M 129/18*** | (2006.01) |
| ***C10M 101/00*** | (2006.01) |
| ***C10M 107/32*** | (2006.01) |
| ***C10M 171/00*** | (2006.01) |
| ***C10M 171/04*** | (2006.01) |
| *C10M 129/66* | (2006.01) |
| *C10N 20/00* | (2006.01) |
| *C10N 30/00* | (2006.01) |
| *C10N 40/30* | (2006.01) |
| *C10N 20/04* | (2006.01) |

(52) U.S. Cl.
CPC ..... *C10M 137/10* (2013.01); *C10M 101/00* (2013.01); *C10M 107/32* (2013.01); *C10M 129/18* (2013.01); *C10M 141/10* (2013.01); *C10M 171/008* (2013.01); *C10M 171/04* (2013.01); *C10M 129/66* (2013.01); *C10M 2207/042* (2013.01); *C10M 2207/2835* (2013.01); *C10M 2223/041* (2013.01); *C10M 2223/047* (2013.01); *C10N 2020/04* (2013.01); *C10N 2020/071* (2020.05); *C10N 2030/70* (2020.05); *C10N 2040/30* (2013.01)

(58) Field of Classification Search
CPC ..... C10M 141/08; C10M 141/10; C10M 137/105; C10M 137/10; C10M 101/00; C10M 107/32; C10M 171/008; C10M 171/04; C10M 129/18; C10M 129/66; C10M 2207/042; C10M 2223/041; C10M 2223/047; C10M 2207/2835; C10N 2230/70; C10N 2220/028; C10N 2020/04; C10N 2240/30
USPC ..... 508/438
See application file for complete search history.

(56) References Cited

U.S. PATENT DOCUMENTS

| | | | | |
|---|---|---|---|---|
| 2009/0082232 | A1* | 3/2009 | Ikeda | C10M 171/008 508/108 |
| 2010/0093568 | A1* | 4/2010 | Tagawa | C10M 101/02 508/133 |
| 2011/0136712 | A1* | 6/2011 | Kaneko | C09K 5/041 508/579 |
| 2013/0207024 | A1* | 8/2013 | Takigawa | C10M 171/008 252/68 |
| 2013/0237463 | A1* | 9/2013 | Yagishita | C10M 141/10 508/365 |

FOREIGN PATENT DOCUMENTS

| | | | |
|---|---|---|---|
| CN | 101484560 | A | 7/2009 |
| CN | 103314089 | A | 9/2013 |

(Continued)

OTHER PUBLICATIONS

International Bureau of WIPO, International Preliminary Report on Patentability in International application No. PCT/JP2015/079983 (dated May 18, 2017).

(Continued)

*Primary Examiner* — Prem C Singh
*Assistant Examiner* — Francis C Campanell
(74) *Attorney, Agent, or Firm* — Leydig, Voit & Mayer, Ltd.

(57) ABSTRACT

The present invention provides a refrigerating machine oil comprising: a base oil; a compound represented by the following formula (1):

(1)

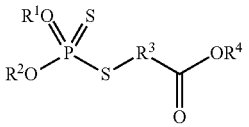

wherein $R^1$ and $R^2$ each independently represent a monovalent hydrocarbon group, $R^3$ represents a divalent hydrocarbon group and $R^4$ represents a hydrogen atom or a monovalent hydrocarbon group; and an epoxy compound.

22 Claims, No Drawings

(56) References Cited

FOREIGN PATENT DOCUMENTS

| | | | |
|---|---|---|---|
| JP | H5-070785 | A | 3/1993 |
| JP | H6-041161 | A | 6/1993 |
| JP | H11-217577 | A | 8/1999 |
| JP | 2005-248038 | A | 9/2005 |
| JP | 2008-013677 | | 1/2008 |
| JP | 2008-150531 | A | 7/2008 |
| JP | 2012-111803 | | 6/2012 |

OTHER PUBLICATIONS

Japan Patent Office, International Search Report in International application No. PCT/JP2015/079983.
Japan Patent Office, Office Action issued in Japanese Application No. 2016-557707 (dated Dec. 4, 2018).
State Intellectual Property Office of the People's Republic of China, Office Action issued in Chinese Application No. 201580058352.5 (dated Apr. 17, 2019).

* cited by examiner

REFRIGERATOR OIL

CROSS-REFERENCE TO RELATED APPLICATIONS

This patent application is the U.S. national phase of International Application No. PCT/JP2015/079983, filed on Oct. 23, 2015, which claims the benefit of Japanese Patent Application No. 2014-224307, filed Nov. 4, 2014, the disclosures of which are incorporated herein by reference in their entireties for all purposes.

TECHNICAL FIELD

The present invention relates to a refrigerating machine oil.

BACKGROUND ART

Lubricating oils are commonly used to ensure the lubricity for a machine element such as a sliding portion. Lubricating oils contain a base oil such as mineral oils or synthetic oils and additives added to the base oil depending on intended properties. The additives to be used are, for example, antiwear agents for the purpose of preventing the wear at sliding portions.

Lubricating oils are sometimes used for specific performances depending on the purpose of use thereof and accordingly the type of usable additives varies depending on the purpose of use of lubricating oils. For example, as described in Patent Literature 1, in a lubricating oil for a refrigerating machine (refrigerating machine oil), the addition of an antiwear agent, etc. to a refrigerating machine oil may cause a problem such as capillary blocking depending on conditions. For this reason, the selection of antiwear agents in the field of refrigerating machine oils is extremely limited compared with the lubricating oils for other purposes of use, and it is thus common to use phosphate esters such as tricresyl phosphate as the antiwear agent to achieve both lubricity (antiwear property) and stability (see Patent Literature 1).

CITATION LIST

Patent Literature

Patent Literature 1: Japanese Unexamined Patent Publication No. 2005-248038

SUMMARY OF INVENTION

Technical Problem

An object of the present invention is to provide a refrigerating machine oil that can achieve both antiwear property and stability in a high level.

Solution to Problem

The present invention provides a refrigerating machine oil comprising: a base oil; a compound represented by the following formula (1):

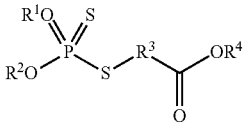

(1)

wherein $R^1$ and $R^2$ each independently represent a monovalent hydrocarbon group, $R^3$ represents a divalent hydrocarbon group and $R^4$ represents a hydrogen atom or a monovalent hydrocarbon group; and an epoxy compound.

The present inventors conducted studies on the refrigerating machine oil which intentionally uses an antiwear agent having a higher activity (specifically, easily inhibits the stability of the refrigerating machine oil) than phosphate esters such as tricresyl phosphate commonly used in the art, and found that when the compound represented by the formula (1) and an epoxy compound are used in combination for a refrigerating machine oil, both the antiwear property and stability can be achieved in a high level, whereby the present invention has been accomplished.

It is preferable that the compound represented by the formula (1) and the epoxy compound satisfy the conditions represented by the following formula (2):

$$0.5 \leq \frac{\left(\frac{N_E}{M_E} \cdot W_E\right)}{\left(\frac{N_S}{M_S} \cdot W_S\right)} \leq 80 \quad (2)$$

wherein $N_E$ represents the number of epoxy groups per molecule of an epoxy compound, $M_E$ represents a molecular weight of the epoxy compound, $W_E$ represents a content of the epoxy compound based on a total amount of the refrigerating machine oil, $N_S$ represents the number of sulfur atoms per molecule of the compound represented by the formula (1), $M_S$ represents a molecular weight of the compound represented by the formula (1), $W_S$ represents a content of the compound represented by the formula (1) based on a total amount of the refrigerating machine oil.

Advantageous Effects of Invention

According to the present invention, a refrigerating machine oil that can achieve both antiwear property and stability in a high level is provided.

DESCRIPTION OF EMBODIMENTS

The refrigerating machine oil according to the present embodiment contains a base oil, a compound represented by the following formula (1):

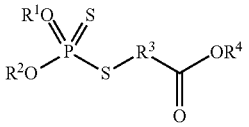

(1)

wherein $R^1$ and $R^2$ each independently represent a monovalent hydrocarbon group, $R^3$ represents a divalent hydrocarbon group and $R^4$ represents a hydrogen atom or a monovalent hydrocarbon group, and an epoxy compound.

The base oils usable are hydrocarbon oils and oxygen-containing oils. Examples of the hydrocarbon oil include mineral oil based hydrocarbon oils and synthetic hydrocarbon oils. Examples of the oxygen-containing oil include esters, polyvinyl ethers, polyalkylene glycols, carbonates, ketones, polyphenyl ethers, silicones, polysiloxanes and perfluoroethers. The base oil preferably contains an oxygen-containing oil and more preferably contains an ester.

Mineral oil based hydrocarbon oils can be obtained by refining a lubricating oil distillate obtained by atmospheric distillation or vacuum distillation of a paraffinic or naphthenic crude oil by a method such as solvent deasphalting, solvent refining, hydrotreating, hydrocracking, solvent dewaxing, hydrodewaxing, clay treatment or sulfuric acid treatment. These refining methods may be used singly, or two or more may be used in combination.

Examples of the synthetic hydrocarbon oil include alkylbenzene, alkyl naphthalene, poly α-olefin (PAO), polybutene, ethylene-α-olefin copolymers.

Examples of the ester include aromatic esters, dibasic acid esters, polyol esters, complex esters, carbonic acid esters and mixtures thereof. Polyol esters are preferable as the ester.

Polyol ester is the ester of a polyhydric alcohol and a fatty acid. Saturated fatty acids are preferably used as the fatty acid. The number of carbon atoms of the fatty acid is preferably 4 to 20, more preferably 4 to 18, further preferably 4 to 9 and particularly preferably 5 to 9. The polyol ester may be a partial ester wherein a part of the hydroxyl groups of a polyhydric alcohol remains as the hydroxyl group without being esterified, a complete ester wherein all the hydroxyl groups have been esterified, or a mixture of the partial ester and the complete ester. The hydroxyl value of the polyol ester is preferably 10 mgKOH/g or less, more preferably 5 mgKOH/g or less and further preferably 3 mgKOH/g or less. The hydroxyl value referred in the present invention means a hydroxyl value measured in conformity with JIS K0070-1992.

Of the fatty acids forming the polyol ester, the proportion of the fatty acids having 4 to 20 carbon atoms is preferably 20 to 100 mol %, more preferably 50 to 100 mol %, further preferably 70 to 100 mol % and particularly preferably 90 to 100 mol %.

Examples of the fatty acid having 4 to 20 carbon atoms specifically include butanoic acid, pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid and eicosanoic acid. These fatty acids may be linear or branched. More specifically, fatty acids are preferably branched at the α position and/or position, more preferably 2-methylpropanoic acid, 2-methylbutanoic acid, 2-methylpentanoic acid, 2-methylhexanoic acid, 2-ethylpentanoic acid, 2-methylheptanoic acid, 2-ethylhexanoic acid, 3,5,5-trimethylhexanoic acid and 2-ethylhexadecanoic acid, with 2-ethylhexanoic acid and 3,5,5-trimethylhexanoic acid being further preferable.

The fatty acid may contain fatty acids other than the fatty acids having 4 to 20 carbon atoms. For example, fatty acids having 21 to 24 carbon atoms may be contained as the fatty acids other than the fatty acids having 4 to 20 carbon atoms. Examples specifically include heneicosanoic acid, docosanoic acid, tricosanoic acid and tetracosanoic acid. These fatty acids may be linear or branched.

The polyhydric alcohol forming the polyol ester preferably used is polyhydric alcohols having 2 to 6 hydroxyl groups. The number of carbon atoms in the polyhydric alcohol is preferably 4 to 12 and more preferably 5 to 10. Specifically preferable are hindered alcohols such as neopentylglycol, trimethylolethane, trimethylolpropane, trimethylolbutane, di-(trimethylolpropane), tri-(trimethylolpropane), pentaerythritol and dipentaerythritol. Pentaerythritol or a mixed alcohol of pentaerythritol and dipentaerythritol are more preferable due to the particularly notable compatibility with a refrigerant and hydrolytic stability.

The content of the base oil is preferably 80% by mass or more, more preferably 90% by mass or more and further preferably 95% by mass or more, based on a total amount of the refrigerating machine oil base oil.

The refrigerating machine oil according to the present embodiment contains a compound represented by the following formula (1).

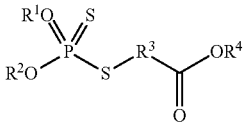

(1)

In the formula (1), $R^1$ and $R^2$ each independently represent a monovalent hydrocarbon group. Examples of the hydrocarbon group include an alkyl group and an aryl group. The number of carbon atoms of the hydrocarbon groups represented by $R^1$ and $R^2$ may be each independently, for example, 1 or more, 2 or more or 3 or more, and, for example, 10 or less, 9 or less or 8 or less. The total number of carbon atoms of the hydrocarbon groups represented by $R^1$ and $R^2$ may be, for example, 2 or more, 3 or more or 4 or more, and, for example, 20 or less, 19 or less or 18 or less.

In the formula (1), $R^3$ represents a divalent hydrocarbon group. Examples of the hydrocarbon group include an alkylene group. The number of carbon atoms of the hydrocarbon group represented by $R^3$ may be, for example, 1 or more, 2 or more or 3 or more, and, for example, 10 or less, 9 or less or 8 or less.

In the formula (1), $R^4$ represents a hydrogen atom or a monovalent hydrocarbon group. Examples of the hydrocarbon group include an alkyl group. The number of carbon atoms of the hydrocarbon group represented by $R^4$ may be, for example, 1 or more, 2 or more or 3 or more, and, for example, 10 or less, 9 or less or 8 or less.

Preferable examples of the compound represented by the formula (1) include phosphorylated carboxylic acid compounds, particularly β-dithiophosphorylated carboxylic acid derivatives. Specific examples of the β-dithiophosphorylated carboxylic acid wherein $R^4$ in the formula (1) is a hydrogen atom preferably include compounds such as 3-(diisobutoxy-thiophosphorylsulfanyl)-2-methyl-propionic acid. Specific examples of the β-dithiophosphoryl carboxylate wherein $R^4$ in the formula (1) is a monovalent hydrocarbon group preferably include compounds such as ethyl-3-[[bis(1-methylethoxy)phosphinothioyl]thio]propionate. The compound represented by the formula (1) may be alkyl esters such as 3-(O,O-diisopropyl-dithiophosphoryl)-propionic acid, 3-(O,O-diisopropyl-dithiophosphoryl)-2-methyl-propionic acid, 3-(O,O-diisobutyl-dithiophosphoryl)-propionic acid, 3-(O,O-diisobutyl-dithiophosphoryl)-2-methyl-propionic acid and ethyl esters of these compounds.

The content of the compound represented by the formula (1) is, in light of improving the lubricity, preferably 0.001% by mass or more, more preferably 0.005% by mass or more and further preferably 0.01% by mass or more, based on a total amount of the refrigerating machine oil. The content of the compound represented by the formula (1) is, in light of improving the stability, preferably 5% by mass or less, more preferably 4% by mass or less and further preferably 3% by mass or less, based on a total amount of the refrigerating machine oil. The content of the compound represented by the formula (1) is, in light of having both lubricity and stability, preferably 0.001 to 5% by mass, 0.001 to 4% by mass, 0.001 to 3% by mass, 0.005 to 5% by mass, 0.005 to 4% by mass, 0.005 to 3% by mass, 0.01 to 5% by mass, 0.01 to 4% by mass or 0.01 to 3% by mass.

The refrigerating machine oil according to the present embodiment contains an epoxy compound. Examples of the epoxy compound include glycidyl ether type epoxy compounds, glycidyl ester type epoxy compounds, oxirane compounds, alkyl oxirane compounds, alicyclic epoxy compounds, epoxidized fatty acid monoesters and epoxidized vegetable oils. These epoxy compounds can be used singly, or two or more can be used in combination.

For example, aryl glycidyl ether type epoxy compounds or alkyl glycidyl ether type epoxy compounds represented by the following formula (3):

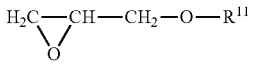

(3)

wherein, $R^{11}$ represents an aryl group or an alkyl group having 5 to 18 carbon atoms, can be used as the glycidyl ether type epoxy compound.

As the glycidyl ether type epoxy compounds represented by the formula (3), n-butylphenyl glycidyl ether, i-butylphenyl glycidyl ether, sec-butylphenyl glycidyl ether, tert-butylphenyl glycidyl ether, pentylphenyl glycidyl ether, hexylphenyl glycidyl ether, heptylphenyl glycidyl ether, octylphenyl glycidyl ether, nonylphenyl glycidyl ether, decylphenyl glycidyl ether, decyl glycidyl ether, undecyl glycidyl ether, dodecyl glycidyl ether, tridecyl glycidyl ether, tetradecyl glycidyl ether and 2-ethylhexyl glycidyl ether are preferable.

When the number of carbon atoms of the alkyl group represented by $R^{11}$ is 5 or more, the stability of the epoxy compound is assured and the decomposition before reacting with moisture, fatty acids or oxidatively degraded products and the self-polymerization, wherein epoxy compounds polymerize with each other can be prevented, whereby the intended functions are likely to be achieved. To the contrary, when the number of carbon atoms of the alkyl group represented by $R^{11}$ is 18 or less, the solubility to a refrigerant is suitably maintained and the inconvenience such as refrigeration failures caused by precipitation in a refrigerating equipment is less likely to occur.

In addition to the epoxy compounds represented by the formula (3), neopentyl glycol diglycidyl ether, trimethylolpropane triglycidyl ether, pentaerythritol tetraglycidyl ether, 1,6-hexanediol diglycidyl ether, sorbitol polyglycidyl ether, polyalkyleneglycol monoglycidyl ether, polyalkyleneglycol diglycidyl ether, etc., can also be used as the glycidyl ether type epoxy compound.

For example, compounds represented by the following formula (4):

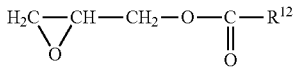

(4)

wherein, $R^{12}$ represents an aryl group, an alkyl group having 5 to 18 carbon atoms or an alkenyl group, can be used as the glycidyl ester type epoxy compound.

As the glycidyl ester type epoxy compounds represented by the formula (4), glycidyl benzoate, glycidyl neodecanoate, glycidyl-2,2-dimethyloctanoate, glycidyl acrylate and glycidyl methacrylate are preferable.

When the number of carbon atoms of the alkyl group represented by $R^{12}$ is 5 or more, the stability of the epoxy compound is assured and the decomposition before reacting with moisture, fatty acids or oxidatively degraded products and the self-polymerization wherein epoxy compounds polymerize with each other can be prevented, whereby the intended functions are likely to be achieved. To the contrary, when the number of carbon atoms of the alkyl group or alkenyl group represented by $R^{12}$ is 18 or less, the solubility to a refrigerant is suitably maintained and the inconvenience such as refrigeration failures caused by precipitation in a refrigerating machine is less likely to occur.

The alicyclic epoxy compounds are those having a partial structure wherein the carbon atoms forming an epoxy group are directly forming the alicyclic ring, represented by the following formula (5).

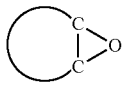

(5)

Preferable examples of the alicyclic epoxy compound include 1,2-epoxycyclohexane, 1,2-epoxycyclopentane, 3',4'-epoxycyclohexylmethyl-3,4-epoxycyclohexane carboxylate, bis(3,4-epoxycyclohexylmethyl) adipate, exo-2,3-epoxynorbornane, bis(3,4-epoxy-6-methylcyclohexylmethyl) adipate, 2-(7-oxabicyclo [4.1.0]hept-3-yl)-spiro (1,3-dioxane-5,3'-[7]oxabicyclo [4.1.0]heptane), 4-(1'-methylepoxyethyl)-1,2-epoxy-2-methylcyclohexane and 4-epoxyethyl-1,2-epoxycyclohexane.

Examples of the allyloxirane compound can include 1,2-epoxy styrene and alkyl-1,2-epoxy styrene.

Examples of the alkyl oxirane compound can include 1,2-epoxybutane, 1,2-epoxypentane, 1,2-epoxyhexane, 1,2-epoxyheptane, 1,2-epoxyoctane, 1,2-epoxynonane, 1,2-epoxydecane, 1,2-epoxyundecane, 1,2-epoxydodecane, 1,2-epoxytridecane, 1,2-epoxytetradecane, 1,2-epoxypentadecane, 1,2-epoxyhexadecane, 1,2-epoxyheptadecane, 1,2-epoxyoctadecane, 1,2-epoxynonadecane and 1,2-epoxyicosane.

Examples of the epoxidized fatty acid monoester can include esters of epoxidized fatty acids having 12 to 20 carbon atoms and alcohol having 1 to 8 carbon atoms or phenol or alkylphenol. The epoxidized fatty acid monoesters used preferably are butyl-, hexyl-, benzyl-, cyclohexyl-, methoxyethyl-, octyl-, phenyl- and butylphenyl esters of epoxystearic acid.

Examples of the epoxidized vegetable oil can include epoxy compounds of vegetable oils such as soybean oil, flaxseed oil and cotton seed oil.

The content of the epoxy compound is, in light of improving the stability, preferably 0.1% by mass or more, more preferably 0.15% by mass or more and further preferably 0.2% by mass or more, based on a total amount of the refrigerating machine oil. The content of the epoxy compound is, in light of improving the lubricity, preferably 5.0% by mass or less, more preferably 3.0% by mass or less and further preferably 2.0% by mass or less, based on a total amount of the refrigerating machine oil. The content of the epoxy compound is, in light of having both stability and lubricity, preferably 0.1 to 5.0% by mass, 0.1 to 3.0% by mass, 0.1 to 2.0% by mass, 0.15 to 5.0% by mass, 0.15 to 3.0% by mass, 0.15 to 2.0% by mass, 0.2 to 5.0% by mass, 0.2 to 3.0% by mass or 0.2 to 2.0% by mass.

It is preferable that the compound represented by the formula (1) and the epoxy compound meet the conditions represented by the following formula (2).

$$0.5 \leq \frac{\left(\frac{N_E}{M_E} \cdot W_E\right)}{\left(\frac{N_S}{M_S} \cdot W_S\right)} \leq 80 \quad (2)$$

In the formula (2), $N_E$ represents the number of epoxy groups per molecule of an epoxy compound, $M_E$ represents a molecular weight of the epoxy compound, $W_E$ represents a content (unit: % by mass) of the epoxy compound based on a total amount of the refrigerating machine oil, $N_S$ represents the number of sulfur atoms per molecule of the compound represented by the formula (1), $M_S$ represents a molecular weight of the compound represented by the formula (1), $W_S$ represents a content (unit: % by mass) of the compound represented by the formula (1) based on a total amount of the refrigerating machine oil.

The following description is provided, for the sake of convenience, with the terms of the second side in the formula (2) defined as E/S (specifically, $E=(N_E/M_E)\cdot W_E$, $S=(N_S/M_S)\cdot W_S$). E/S is preferably 0.5 or more, more preferably 0.6 or more and further preferably 0.7 or more. When E/S is 0.5 or more, the stability of the refrigerating machine oil can be improved. E/S is preferably 80 or less, more preferably 76 or less and further preferably 72 or less. When E/S is 80 or less, the antiwear property of the refrigerating machine oil can be improved. E/S is, in light of having both stability and antiwear property, preferably 0.5 to 80, 0.5 to 76, 0.5 to 72, 0.6 to 80, 0.6 to 76, 0.6 to 72, 0.7 to 80, 0.7 to 76 or 0.7 to 72.

When the refrigerating machine oil contains a plurality of epoxy compounds, $E_i=(N_E/M_E)\cdot W_E$ is calculated for each of the epoxy compounds and the sum of all calculated $E_i$ values is defined as E and used for the formula (2). Similarly, when the refrigerating machine oil contains a plurality of the compounds represented by the formula (1), $S_i=(N_S/M_S)\cdot W_S$ is calculated for each of the compounds and the sum of all calculated $S_i$ values is defined as S and used for the formula (2).

The refrigerating machine oil may further contain other additives. Examples of the other additives include an antioxidant, a friction modifier, antiwear agents other than the compound represented by the formula (1), an extreme pressure agent, a rust preventive and a metal deactivator.

The kinematic viscosity at 40° C. of the refrigerating machine oil may be preferably 3 $mm^2/s$ or more, more preferably 4 $mm^2/s$ or more and further preferably 5 $mm^2/s$ or more. The kinematic viscosity at 40° C. of the refrigerating machine oil may be preferably 1000 $mm^2/s$ or less, more preferably 500 $mm^2/s$ or less and further preferably 400 $mm^2/s$ or less. The kinematic viscosity at 100° C. of the refrigerating machine oil may be preferably 1 $mm^2/s$ or more and more preferably 2 $mm^2/s$ or more. The kinematic viscosity at 100° C. of the refrigerating machine oil may be preferably 100 $mm^2/s$ or less and more preferably 50 $mm^2/s$ or less. The kinematic viscosity referred in the present invention means a kinematic viscosity measured in conformity with JIS K2283:2000.

The pour point of the refrigerating machine oil may be preferably −10° C. or less and more preferably −20° C. or less. The pour point referred in the present invention means a pour point measured in conformity with JIS K2269-1987.

The volume resistivity of the refrigerating machine oil may be preferably $1.0\times10^9$ Ω·m or more, more preferably $1.0\times10^{10}$ Ω·m or more and further preferably $1.0\times10^{11}$ Ω·m or more. When the refrigerating machine oil is used particularly for a hermetic refrigerating machine, it is preferable that an electric insulation be high. The volume resistivity referred in the present invention means a volume resistivity measured at 25° C. in conformity with JIS C2101:1999 "Testing Methods of Electrical Insulating Oils".

The moisture content of the refrigerating machine oil may be preferably 200 ppm or less, more preferably 100 ppm or less and further preferably 50 ppm or less based on a total amount of the refrigerating machine oil. When used particularly for a hermetic refrigerating machine, a moisture content is preferably low in light of the influence to the thermal and chemical stability and the electric insulation of the refrigerating machine oil.

The acid value of the refrigerating machine oil may be preferably 1.0 mgKOH/g or less, more preferably 0.1 mgKOH/g or less in light of preventing the corrosion of the metals used in a refrigerating machine or pipes. The acid value referred in the present invention means an acid value measured in conformity with JIS K2501:2003 "Petroleum Products and Lubricants—Determination of Neutralization Number".

The ash content of the refrigerating machine oil may be preferably 100 ppm or less and more preferably 50 ppm or less in light of enhancing the thermal and chemical stability of the refrigerating machine oil and reducing the occurrence of sludge. The ash content referred in the present invention means an ash content measured in conformity with JIS K2272:1998 "Crude Oil and Petroleum Products—Determination of Ash and Sulfated Ash".

The refrigerating machine oil according to the present embodiment is used with a refrigerant. The working fluid composition for a refrigerating machine according to the present embodiment contains the refrigerating machine oil described above and a refrigerant. Examples of the refrigerant include fluorine-containing ether refrigerants such as saturated hydrofluorocarbon refrigerants, unsaturated hydrofluorocarbon refrigerants, hydrocarbon refrigerants and perfluoroethers, bis(trifluoromethyl)sulfide refrigerants, trifluoroiodomethane refrigerants and natural refrigerants such as ammonia and carbon dioxide.

Examples of the saturated hydrofluorocarbon refrigerants include saturated hydrofluorocarbons preferably having 1 to 3 carbon atoms and more preferably having 1 to 2 carbon atoms. Specific examples include, difluoromethane (R32), trifluoromethane (R23), pentafluoroethane (R125), 1,1,2,2-tetrafluoroethane (R134), 1,1,1,2-tetrafluoroethane (R134a), 1,1,1-trifluoroethane (R143a), 1,1-difluoroethane (R152a), fluoroethane (R161), 1,1,1,2,3,3,3-heptafluoropropane (R227ea), 1,1,1,2,3,3-hexafluoropropane (R236ea), 1,1,1,3, 3,3-hexafluoropropane (R236fa), 1,1,1,3,3-pentafluoropropane (R245fa) and 1,1,1,3,3-pentafluorobutane (R365mfc) or mixtures of two or more thereof.

Preferable examples of the saturated hydrofluorocarbon refrigerant include, although suitably selected from the above to meet purpose of use and required performance, R32 used alone; R23 used alone; R134a used alone; R125 used alone; a mixture of R134a/R32=60 to 80% by mass/40 to 20% by mass; a mixture of R32/R125=40 to 70% by mass/60 to 30% by mass; a mixture of R125/R143a=40 to 60% by mass/60 to 40% by mass; a mixture of R134a/R32/R125=60% by mass/30% by mass/10% by mass; a mixture of R134a/R32/R125=40 to 70% by mass/15 to 35% by mass/5 to 40% by mass and a mixture of R125/R134a/R143a=35 to 55% by mass/1 to 15% by mass/40 to 60% by mass. Further specifically usable include a mixture of R134a/R32=70/30% by mass; a mixture of R32/R125=60/40% by mass; a mixture of R32/R125=50/50% by mass (R410A); a mixture of R32/R125=45/55% by mass (R410B); a mixture of R125/R143a 50/50% by mass (R507C); a mixture of R32/R125/R134a=30/10/60% by mass; a mixture of R32/R125/R134a=23/25/52% by mass (R407C); a mixture of R32/R125/R134a=25/15/60% by mass (R407E) and a mixture of R125/R134a/R143a=44/4/52% by mass (R404A).

Preferable examples of the unsaturated hydrofluorocarbon (HFO) refrigerant include fluoropropene having 3 to 5 fluorine atoms. Preferably used are specifically, more preferable examples include one of any, or mixtures of two or more of 1,1,2-trifluoroethylene (HFO-1123), 1,2,3,3,3-pentafluoropropene (HFO-1225ye), 1,3,3,3-tetrafluoropropene (HFO-1234ze), -tetrafluoropropene (HFO-1234yf), 1,2,3,3-tetrafluoropropene (HFO-1234ye) and 3,3,3-trifluoropropene (HFO-1243zf). In light of refrigerant properties, one or two or more selected from HFO-1225ye, HFO-1234ze and HT 0-1234yf are preferable.

Preferable examples of the hydrocarbon refrigerant include hydrocarbons having 1 to 5 carbon atoms. Specific examples include methane, ethylene, ethane, propylene, propane (R290), cyclopropane, normal butane, isobutane, cyclobutane, methylcyclopropane, 2-methylbutane and normal pentane or mixtures of two or more thereof. Of these, it is preferable to use hydrocarbons which are a gas at 25° C. and one atmospheric pressure such as propane, normal butane, isobutane and 2-methylbutane or mixtures thereof.

In a refrigerating machine, the refrigerating machine oil according to the present embodiment is typically present in the form of a working fluid composition for a refrigerating machine as being mixed with a refrigerant. The content of the refrigerating machine oil in the working fluid composition for a refrigerating machine is not particularly limited but is preferably 1 to 500 mass parts and more preferably 2 to 400 mass parts with respect to 100 mass parts of the refrigerant.

The refrigerating machine oil and the working fluid composition for a refrigerating machine according to the present embodiment are preferably used for cooling units in air conditioners with a reciprocating or rotary hermetic compressor, fridge storages, open- or sealed-type automotive air conditioners, dehumidifiers, water heaters, freezers, freezing refrigerating warehouses, vending machines, display cases and chemical plants, and the like and refrigerating machines with a centrifugal compressor and the like.

Examples

Hereinafter, the present invention is further specifically described with reference to Examples, but is not limited thereto.

In Examples and Comparative Examples, the base oils shown in Table 1 (esters of a polyhydric alcohol and a mixed fatty acid of the fatty acid A and the fatty acid B) and the following additives were used in the amounts added shown in Tables 2 and 3 to prepare refrigerating machine oils. The following antiwear property test and stability test were carried out using each of the refrigerating machine oils of Examples and Comparative Examples.

TABLE 1

| Base oil number | | A1 | A2 | A3 | A4 |
|---|---|---|---|---|---|
| Polyhydric alcohol | | penta-erythritol | penta-erythritol | dipenta-erythritol | dipenta-erythritol |
| Fatty acid A | Type | 2-methyl-propanoic acid | 2-ethyl-hexanoic acid | 2-methyl-butanoic acid | 2-ethyl-hexanoic acid |
| | Mixing ratio of fatty acids (mol %) | 35 | 50 | 35 | 50 |
| Fatty acid B | Type | 3,5,5-trimethyl-hexanoic acid | 3,5,5-trimethyl-hexanoic acid | n-pentanoic acid | 3,5,5-trimethyl-hexanoic acid |
| | Mixing ratio of fatty acids (mol %) | 65 | 50 | 65 | 50 |
| Kinematic viscosity | 40° C. ($mm^2/s$) | 69.4 | 68.4 | 68.2 | 222.5 |
| | 100° C. ($mm^2/s$) | 8.2 | 8.4 | 10.0 | 18.8 |

<Additives>

B1: Glycidyl neodecanoate

B2: 2-Ethylhexyl glycidyl ether

B3: 1,2-Epoxytetradecane

C1: Compound represented by the following formula (6)

C2: Compound represented by the following formula (7)

D1: Tricresyl phosphate (6)

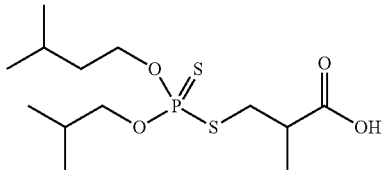

(7)

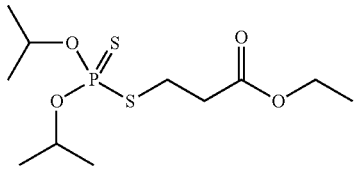

(Antiwear Property Test)

The antiwear property test was carried out using a Shinko Engineering Co., Ltd. high pressure ambience friction & wear tester (a rotating and sliding system by a rotating vane and a fixed disk material) capable of creating a refrigerant ambience close to an actual compressor. The test conditions included an oil amount: 600 ml, a test temperature: 110° C., a test container internal pressure: 1.1 MPa, the number of rotations: 400 rpm, an applied load: 70 kgf and a test time: 1 hour, with R32, R410A or HFO-1234yf as the refrigerant, SKH-51 as the vane material and FC250 as the disk material used, respectively. The evaluation of antiwear property was carried out based on the wear depth of the vane material since the amount of wear loss of the disk material was extremely small. The obtained results are shown in Tables 2 and 3.

(Stability Test)

In the stability test carried out in conformity with JIS K2211-09 (autoclave test), 80 g of a sample oil adjusted to contain 300 ppm of moisture was weighed in an autoclave, a catalyst (wires of iron, copper and aluminum all having an outer diameter of 1.6 mm×a length of 50 mm) and 20 g of a refrigerant (R32, R410A or HFO-1234yf) were encapsulated, followed by heating to 150° C. to measure the appearance and acid value (JIS C2101) of the sample oils 150 hours later. The obtained results are shown in Tables 2 and 3.

TABLE 2

| | | Example 1 | Example 2 | Example 3 | Example 4 | Example 5 |
|---|---|---|---|---|---|---|
| Composition of base oil (% by mass, based on total amount of base oil) | A1 | 100 | — | — | 100 | — |
| | A2 | — | — | 30 | — | — |
| | A3 | — | 100 | — | — | 100 |
| | A4 | — | — | 70 | — | — |
| Composition of refrigerating machine oil (% by mass, total amount of refrigerating machine oil) | Base oil | Balance | Balance | Balance | Balance | Balance |
| | B1 | 1 | 0.5 | — | 1 | — |
| | B2 | — | — | — | — | 3 |
| | B3 | — | — | 5 | — | — |
| | C1 | 0.01 | — | — | 0.005 | — |
| | C2 | — | 0.5 | 2 | — | 0.01 |
| | D1 | — | — | — | — | — |
| E/S | | 71.9 | 0.69 | 1.85 | 143.86 | 253.22 |
| Antiwear property test (Refrigerant: R32) | Wear depth (μm) | 6.8 | 8.2 | 7.2 | 11.5 | 15.4 |
| Stability test (Refrigerant: R32) | Appearance | No precipitation | No precipitation | No precipitation | No precipitation | No precipitation |
| | Acid value (mgKOH/g) | 0.05 | 0.07 | 0.05 | 0.04 | 0.05 |
| Antiwear property test (Refrigerant: R410A) | Wear depth (μm) | 5.9 | 7.7 | 6.8 | 10.1 | 13.3 |
| Stability test (Refrigerant: R410A) | Appearance | No precipitation | No precipitation | No precipitation | No precipitation | No precipitation |
| | Acid value (mgKOH/g) | 0.03 | 0.04 | 0.03 | 0.01 | 0.03 |
| Antiwear property test (Refrigerant: HFO-1234yf) | Wear depth (μm) | 7.8 | 9.4 | 8.6 | 12.6 | 14.9 |
| Stability test (Refrigerant: HFO-1234yf) | Appearance | No precipitation | No precipitation | No precipitation | No precipitation | No precipitation |
| | Acid value (mgKOH/g) | 0.09 | 0.09 | 0.07 | 0.05 | 0.08 |

TABLE 1

| | | Comp. Example 1 | Comp. Example 2 | Comp. Example 3 | Comp. Example 4 |
|---|---|---|---|---|---|
| Composition of base oil (% by mass, based on total amount of base oil) | A1 | 100 | — | — | — |
| | A2 | — | 100 | — | 30 |
| | A3 | — | — | 100 | — |
| | A4 | — | — | — | 70 |
| Composition of refrigerating machine oil (% by mass, total amount of refrigerating machine oil) | Base oil | Balance | Balance | Balance | Balance |
| | B1 | 1 | — | — | — |
| | B2 | — | 1 | — | — |
| | B3 | — | — | — | 5 |
| | C1 | — | — | 0.01 | — |
| | C2 | — | — | — | — |
| | D1 | — | — | — | 2 |
| E/S | | — | — | 0 | — |
| Antiwear property test (Refrigerant: R32) | Wear depth (μm) | 18.8 | 19.3 | 8.9 | 16.5 |
| Stability test (Refrigerant: R32) | Appearance | No precipitation | No precipitation | No precipitation | No precipitation |
| | Acid value (mgKOH/g) | 0.02 | 0.01 | 0.33 | 0.17 |
| Antiwear property test (Refrigerant: R410A) | Wear depth (μm) | 16.9 | 18.7 | 7.6 | 17.1 |
| Stability test (Refrigerant: R410A) | Appearance | No precipitation | No precipitation | No precipitation | No precipitation |
| | Acid value (mgKOH/g) | 0.01 | 0.01 | 0.25 | 0.21 |
| Antiwear property test (Refrigerant: HFO-1234yf) | Wear depth (μm) | 17.7 | 22.1 | 8.5 | 17.3 |
| Stability test (Refrigerant: HFO-1234yf) | Appearance | No precipitation | No precipitation | No precipitation | No precipitation |
| | Acid value (mgKOH/g) | 0.02 | 0.02 | 0.35 | 0.38 |

The invention claimed is:

1. A refrigerating machine oil comprising:

a base oil;

a compound represented by the following formula (1):

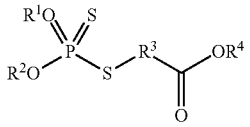

(1)

wherein $R^1$ and $R^2$ each independently represent a monovalent hydrocarbon group, $R^3$ represents a divalent hydrocarbon group and $R^4$ represents a hydrogen atom or a monovalent hydrocarbon group; and an epoxy compound consisting of at least one selected from the group consisting of glycidyl ether type epoxy compounds, glycidyl ester type epoxy compounds, and oxirane compounds;

wherein the base oil consists of an ester of a polyhydric alcohol and a fatty acid, wherein the polyhydric alcohol comprises at least one selected from the group consisting of neopentylglycol, trimethylolethane, trimethylolpropane, trimethylolbutane, di-(trimethylolpropane), tri-(trimethylolpropane), pentaerythritol and dipentaerythritol, and the fatty acid comprises at least one selected from the group consisting of butanoic acid, pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic, eicosanoic acid, 2-methylpropanoic acid, 2-methylbutanoic acid, 2-methylpentanoic acid, 2-methylhexanoic acid, 2-ethylpentanoic acid, 2-methylheptanoic acid, 2-ethylhexanoic acid, 3,5,5-trimethylhexanoic acid, and 2-ethylhexadecanoic acid, and wherein a content of the compound represented by the formula (1) is 0.001% by mass or more and 3% by mass or less, a content of the epoxy compound is 0.1% by mass or more and 5.0% by mass or less, and a content of the base oil is 80% by mass or more based on a total amount of the refrigerating machine oil.

2. The refrigerating machine oil according to claim 1, wherein the compound represented by the formula (1) and the epoxy compound satisfy a condition represented by the following formula (2):

$$0.5 \leq \frac{\left(\frac{N_E}{M_E} \cdot W_E\right)}{\left(\frac{N_S}{M_S} \cdot W_S\right)} \leq 80 \quad (2)$$

wherein $N_E$ represents the number of epoxy groups per molecule of the epoxy compound, $M_E$ represents a molecular weight of the epoxy compound, $W_E$ represents a content of the epoxy compound based on a total amount of the refrigerating machine oil, $N_S$ represents the number of sulfur atoms per molecule of the compound represented by the formula (1), $M_S$ represents a molecular weight of the compound represented by the formula (1), and $W_S$ represents a content of the compound represented by the formula (1) based on a total amount of the refrigerating machine oil.

3. The refrigerating machine oil according to claim 1, wherein a content of the compound represented by the formula (1) is 0.01% by mass or more and 3% by mass or less, and a content of the epoxy compound is 0.1% by mass or more and 5.0% by mass or less, based on a total amount of the refrigerating machine oil.

4. The refrigerating machine oil according to claim 3, wherein the ester is an ester of a polyhydric alcohol and a fatty acid, wherein the polyhydric alcohol comprises pentaerythritol or a mixed alcohol of pentaerythritol and dipentaerythritol, and the fatty acid comprises at least one selected from the group consisting of 2-methylpropanoic acid, 2-methylbutanoic acid, 2-methylpentanoic acid, 2-methylhexanoic acid, 2-ethylpentanoic acid, 2-methylheptanoic acid, 2-ethylhexanoic acid, and 3,5,5-trimethylhexanoic acid.

5. The refrigerating machine oil according to claim 4, wherein $R^1$ and $R^2$ in formula (1) each independently represents an alkyl group having 1 or more and 10 or less of carbons.

6. The refrigerating machine oil according to claim 5, wherein $R^4$ in formula (1) represents a hydrogen atom.

7. A refrigerating machine oil comprising:

a base oil comprising an ester;

a compound represented by the following formula (1):

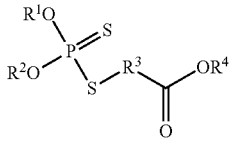

(1)

wherein $R^1$ and $R^2$ each independently represent a monovalent hydrocarbon group, $R^3$ represents a divalent hydrocarbon group and $R^4$ represents a hydrogen atom or a monovalent hydrocarbon group; and an epoxy compound consisting of at least one selected from the group consisting of glycidyl ether type epoxy compounds, glycidyl ester type epoxy compounds, and oxirane compounds, wherein the ester is an ester of a polyhydric alcohol and a fatty acid, wherein the polyhydric alcohol comprises at least one selected from the group consisting of neopentylglycol, trimethylolethane, trimethylolpropane, trimethylolbutane, di-(trimethylolpropane), tri-(trimethylolpropane), pentaerythritol and dipentaerythritol, and the fatty acid comprises at least one selected from the group consisting of butanoic acid, pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic, eicosanoic acid, 2-methylpropanoic acid, 2-methylbutanoic acid, 2-methylpentanoic acid, 2-methylhexanoic acid, 2-ethylpentanoic acid, 2-methylheptanoic acid, 2-ethylhexanoic acid, 3,5,5-trimethylhexanoic acid, and 2-ethylhexadecanoic acid, and, wherein a content of the compound represented by the formula (1) is 0.001% by mass or more and 3% by mass or less, a content of the epoxy compound is 0.1% by mass or more and 5.0% by mass or less, and a content of the base oil is 80% by mass or more based on a total amount of the refrigerating machine oil.

8. The refrigerating machine oil according to claim 7, wherein the compound represented by formula (1) and the epoxy compound satisfy a condition represented by the following formula (2):

$$0.5 \leqq \frac{\left(\frac{N_E}{M_E} \cdot W_E\right)}{\left(\frac{N_S}{M_S} \cdot W_S\right)} \leqq 80 \quad (2)$$

wherein $N_E$ represents the number of epoxy groups per molecule of the epoxy compound, $M_E$ represents a molecular weight of the epoxy compound, $W_E$ represents a content of the epoxy compound based on a total amount of the refrigerating machine oil, $N_S$ represents the number of sulfur atoms per molecule of the compound represented by the formula (1), $M_S$ represents a molecular weight of the compound represented by the formula (1), and $W_S$ represents a content of the compound represented by the formula (1) based on a total amount of the refrigerating machine oil.

9. The refrigerating machine oil according to claim 8, wherein the ester is an ester of a polyhydric alcohol and a fatty acid, wherein the polyhydric alcohol comprises pentaerythritol or a mixed alcohol of pentaerythritol and dipentaerythritol, and the fatty acid comprises at least one selected from the group consisting of 2-methylpropanoic acid, 2-methylbutanoic acid, 2-methylpentanoic acid, 2-methylhexanoic acid, 2-ethylpentanoic acid, 2-methylheptanoic acid, 2-ethylhexanoic acid, and 3,5,5-trimethylhexanoic acid.

10. The refrigerating machine oil according to claim 9, wherein $R^1$ and $R^2$ in formula (1) each independently represents an alkyl group having 3 or more and 8 or less of carbons.

11. The refrigerating machine oil according to claim 10, wherein a content of the compound represented by formula (1) is 0.01% by mass or more and 3% by mass or less, and a content of the epoxy compound is 0.1% by mass or more and 5.0% by mass or less, based on a total amount of the refrigerating machine oil.

12. The refrigerating machine oil according to claim 11, wherein $R^4$ in formula (1) represents a hydrogen atom.

13. A working fluid composition for a refrigerating machine comprising:

a refrigerant; and a refrigerating machine oil comprising:

a base oil comprising an ester;

a compound represented by the following formula (1):

(1)

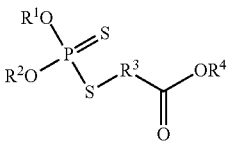

wherein $R^1$ and $R^2$ each independently represents a monovalent hydrocarbon group, $R^3$ represents a divalent hydrocarbon group, and $R^4$ represents a hydrogen atom or a monovalent hydrocarbon group; and an epoxy compound consisting of at least one selected from the group consisting of glycidyl ether type epoxy compounds, glycidyl ester type epoxy compounds, and oxirane compounds, wherein the ester is an ester of a polyhydric alcohol and a fatty acid, wherein the polyhydric alcohol comprises at least one selected from the group consisting of neopentylglycol, trimethylolethane, trimethylolpropane, trimethylolbutane, di-(trimethylolpropane), tri-(trimethylolpropane), pentaerythritol and dipentaerythritol, and the fatty acid comprises at least one selected from the group consisting of butanoic acid, pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic, eicosanoic acid, 2-methylpropanoic acid, 2-methylbutanoic acid, 2-methylpentanoic acid, 2-methylhexanoic acid, 2-ethylpentanoic acid, 2-methylheptanoic acid, 2-ethylhexanoic acid, 3,5,5-trimethylhexanoic acid, and 2-ethylhexadecanoic acid, and, wherein a content of the compound represented by the formula (1) is 0.001% by mass or more and 3% by mass or less, a content of the epoxy compound is 0.1% by mass or more and 5.0% by mass or less, and a content of the base oil is 80% by mass or more based on a total amount of the refrigerating machine oil.

14. The working fluid composition according to claim 13, wherein the compound represented by formula (1) and the epoxy compound satisfy a condition represented by the following formula (2):

$$0.5 \leqq \frac{\left(\frac{N_E}{M_E} \cdot W_E\right)}{\left(\frac{N_S}{M_S} \cdot W_S\right)} \leqq 80 \quad (2)$$

wherein $N_E$ represents the number of epoxy groups per molecule of the epoxy compound, $M_E$ represents a molecular weight of the epoxy compound, $W_E$ represents a content of the epoxy compound base on a total amount of the refrigerating machine oil, $N_S$ represents the number of sulfur atoms per molecule of the compound represented by the formula (1), $M_S$ represents a molecular weight of the compound represented by the formula (1), and $W_S$ represents a content of the compound represented by the formula (1) based on a total amount of the refrigerating machine oil.

15. The working fluid composition according to claim 14, wherein the refrigerant comprises at least one selected from a saturated hydrofluorocarbon refrigerant and an unsaturated hydrofluorocarbon refrigerant.

16. The working fluid composition according to claim 15, wherein the ester is an ester of a polyhydric alcohol and a fatty acid, wherein the polyhydric alcohol comprises pentaerythritol or a mixed alcohol of pentaerythritol and dipentaerythritol, and the fatty acid comprises of at least one selected from the group consisting of 2-methylpropanoic acid, 2-methylbutanoic acid, 2-methylpentanoic acid, 2-methylhexanoic acid, 2-ethylpentanoic acid, 2-methylheptanoic acid, 2-ethylhexanoic acid, and 3,5,5-trimethylhexanoic acid.

17. The working fluid composition according to claim 16, wherein the saturated hydrofluorocarbon refrigerant comprises R32 or R410A.

18. The working fluid composition according to claim 16, wherein the unsaturated hydrofluorocarbon refrigerant comprises HFO-1234yf.

19. The refrigerating machine oil according to claim 2, wherein the fatty acid comprises at least one selected from the group consisting of n-pentanoic acid, 2-methylpropanoic acid, 2-methylbutanoic acid, 2-ethylhexanoic acid, and 3,5,5-trimethylhexanoic acid.

20. The refrigerating machine oil according to claim 8, wherein the fatty acid comprises at least one selected from the group consisting of n-pentanoic acid, 2-methylpropanoic acid, 2-methylbutanoic acid, 2-ethylhexanoic acid, and 3,5,5-trimethylhexanoic acid.

21. The working fluid composition according to claim 17, wherein the fatty acid comprises at least one selected from the group consisting of n-pentanoic acid, 2-methylpropanoic acid, 2-methylbutanoic acid, 2-ethylhexanoic acid, and 3,5,5-trimethylhexanoic acid.

22. The working fluid composition according to claim 18, wherein the fatty acid comprises at least one selected from the group consisting of n-pentanoic acid, 2-methylpropanoic acid, 2-methylbutanoic acid, 2-ethylhexanoic acid, and 3,5,5-trimethylhexanoic acid.

* * * * *